US006854886B2

(12) United States Patent
Piechocki et al.

(10) Patent No.: US 6,854,886 B2
(45) Date of Patent: Feb. 15, 2005

(54) WATERTIGHT CLOSURE FOR A RECLOSABLE PACKAGE

(75) Inventors: Duane Piechocki, Pleasantville, NY (US); Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 90 days.

(21) Appl. No.: 10/185,656

(22) Filed: Jun. 28, 2002

(65) Prior Publication Data

US 2004/0001650 A1 Jan. 1, 2004

(51) Int. Cl.[7] ..... B65D 33/16
(52) U.S. Cl. ..... 383/59; 383/63; 24/584.1
(58) Field of Search ..... 383/59, 63, 64, 383/65; 24/584.1, 585.11, 585.12, 585.1, 399, 400

(56) References Cited

U.S. PATENT DOCUMENTS

| | | | | | |
|---|---|---|---|---|---|
| 2,271,211 | A | * | 1/1942 | Stockton | 24/384 |
| 3,102,570 | A | * | 9/1963 | Fairchilds | 383/59 |
| 3,343,233 | A | * | 9/1967 | Gould | 24/400 |
| 3,372,442 | A | | 3/1968 | Ishimatsu | |
| 4,204,565 | A | * | 5/1980 | Nohmura | 383/99 |
| 4,212,337 | A | | 7/1980 | Kamp | |
| 5,351,369 | A | | 10/1994 | Swain | |
| 5,509,734 | A | * | 4/1996 | Ausnit | 383/63 |
| 5,511,507 | A | * | 4/1996 | Allen | 114/347 |
| 6,045,264 | A | * | 4/2000 | Miniea | 383/41 |
| 6,088,887 | A | * | 7/2000 | Bois | 24/399 |
| 6,185,796 | B1 | * | 2/2001 | Ausnit | 24/585.1 |
| 6,305,844 | B1 | * | 10/2001 | Bois | 383/64 |
| 6,644,854 | B2 | * | 11/2003 | Lien | 383/66 |

FOREIGN PATENT DOCUMENTS

| | | | | |
|---|---|---|---|---|
| EP | 000547966 A | * | 6/1993 | 383/65 |
| EP | 0 564 261 A1 | | 10/1993 | |
| EP | 0 836 814 A1 | | 4/1998 | |
| EP | 1 344 467 A1 | | 9/2003 | |

* cited by examiner

*Primary Examiner*—Jes F. Pascua
(74) *Attorney, Agent, or Firm*—Pitney Hardin LLP

(57) ABSTRACT

A watertight closure for a reclosable package has first and second mutually interlocking profiles. Together, the profiles have two sets of interlocking members, one on either side of a central portion. There, at least one profile has a collapsible member in its central portion. The other profile may have a compressing member or a collapsible member opposite to the collapsible member, or it may have neither. In any event, when the first and second mutually interlocking profiles are joined to one another, the collapsible member encounters and compresses against the other profile to create a watertight seal.

6 Claims, 7 Drawing Sheets

WATERTIGHT CLOSURE FOR A RECLOSABLE PACKAGE

BACKGROUND OF THE INVENTION

1. Field of the Invention

The present invention relates to the packaging art, and, more particularly, to the art of reclosable plastic bags or packages having extruded zippers. In particular, the present invention relates to extruded zippers having two sets of mutually interlocking members separated by at least one compressible or partially collapsible member, the latter forming a watertight seal when the mutually interlocking members are closed.

2. Description of the Prior Art

Reclosable bags used, for example, for storing household foodstuffs are typically made of polyethylene. As shown in U.S. Pat. No. 3,416,199 to Imamura, which is commonly assigned with the present invention, a reclosable bag may be formed of two opposed walls and having a mouth equipped with fastener profiles. These profiles include a male profile attached to one wall and a female profile attached to the other wall. The profiles are shaped so that, when they are aligned and pressed together into an engaging relationship, they form a continuous closure for the bag. The bag may be opened by pulling the walls apart at the mouth, thereby separating the male and female profiles from one another.

The prior art is replete with different shapes and arrangements for the male and female profiles. In many cases, the profiles are designed to provide relatively high resistance to opening from inside the package, while rendering the package relatively easy to open from the outside.

Because the male and female profiles must be shaped so as to be readily interlocked with one another, they may not form an entirely airtight closure. For this reason, peel seals are used in the reclosable plastic packages used for the retail sale of foodstuffs to ensure that the packages remain hermetically sealed prior to sale. Moreover, the peel seals can also serve a tamper-evident function by whitening or otherwise discoloring when being opened, thereby providing a means by which a prospective purchaser could be alerted to the possibility that the package had been opened prior to purchase.

Following purchase, there may still be a need to form a hermetic seal after the initial opening of the package to preserve the freshness of any contents remaining in the package. The present invention is a watertight closure which provides such a seal.

SUMMARY OF THE INVENTION

Accordingly, the present invention is a watertight closure for a reclosable package, and a reclosable package which incorporates the watertight closure.

The watertight closure comprises first and second mutually interlocking profiles, which together have two sets of interlocking members separated from one another by a central portion of the first and second profiles. Each of the first and second profiles has a web and two interlocking members separated from one another thereon.

The web of one of the first and second mutually interlocking profiles has a collapsible member between its respective interlocking members. The web of the other of the first and second mutually interlocking profiles may have a compressing member or another collapsible member opposite to the collapsible member and between its respective interlocking members, or it may have neither member. When the first and second mutually interlocking profiles are joined to one another, the collapsible member encounters and is compressed by the opposite profile creating a watertight seal in the central portion of the joined profiles.

The reclosable package has a first wall and a second wall joined to form an enclosure with a mouth defined by wall edges. The first profile of the present watertight closure extends along an internal surface of the first wall adjacent to the mouth of the package, and the second profile extends along an internal surface of the second wall adjacent to the mouth. The reclosable package has a watertight seal when the first and second mutually interlocking profiles are joined to one another.

The present invention will now be described in more complete detail with frequent reference being made to the drawings identified below.

DETAILED DESCRIPTION OF THE PREFERRED EMBODIMENT

Figure 1:
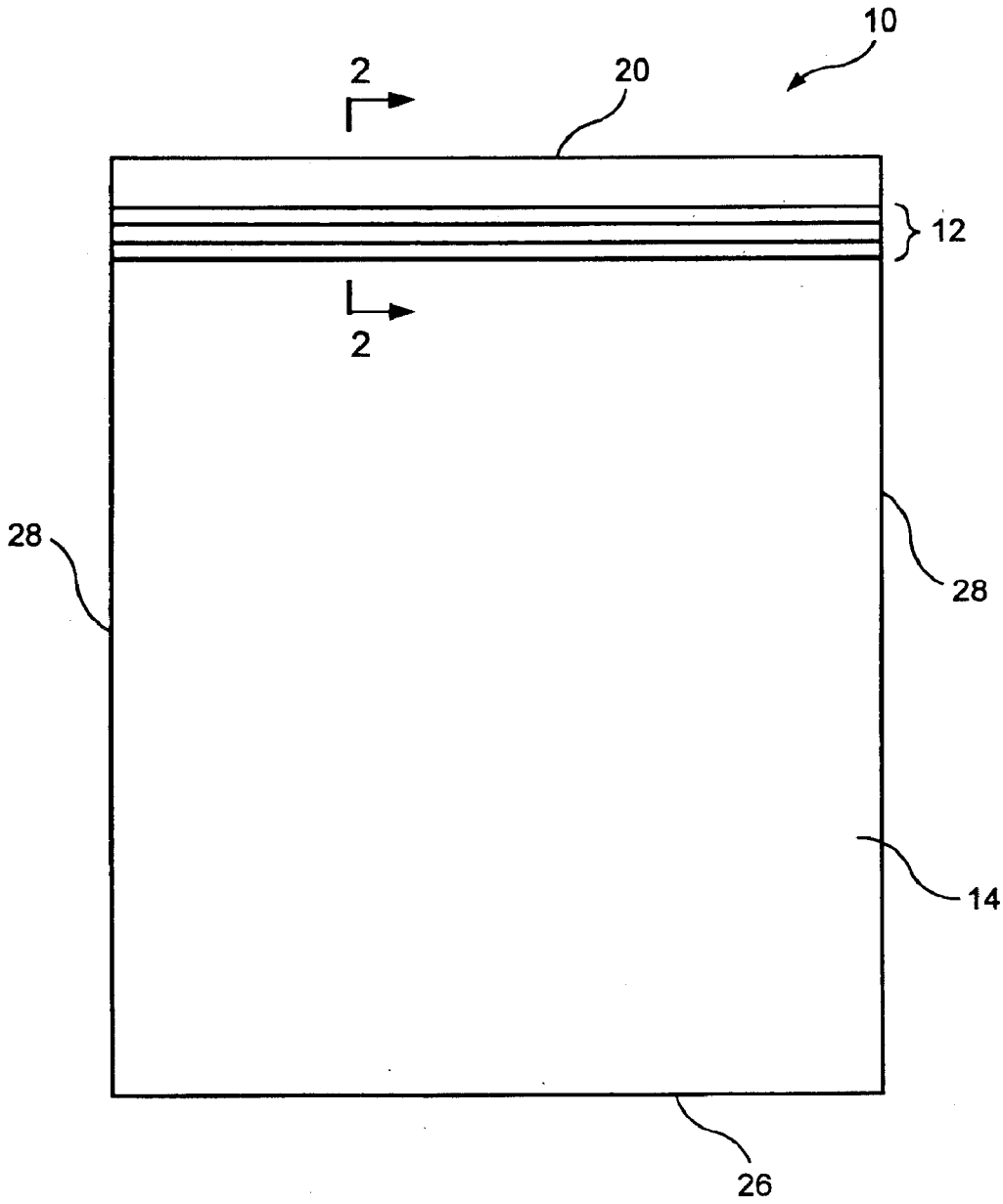
FIG. 1 is a plan view of a reclosable bag having the watertight closure of the present invention.
Figure 2:
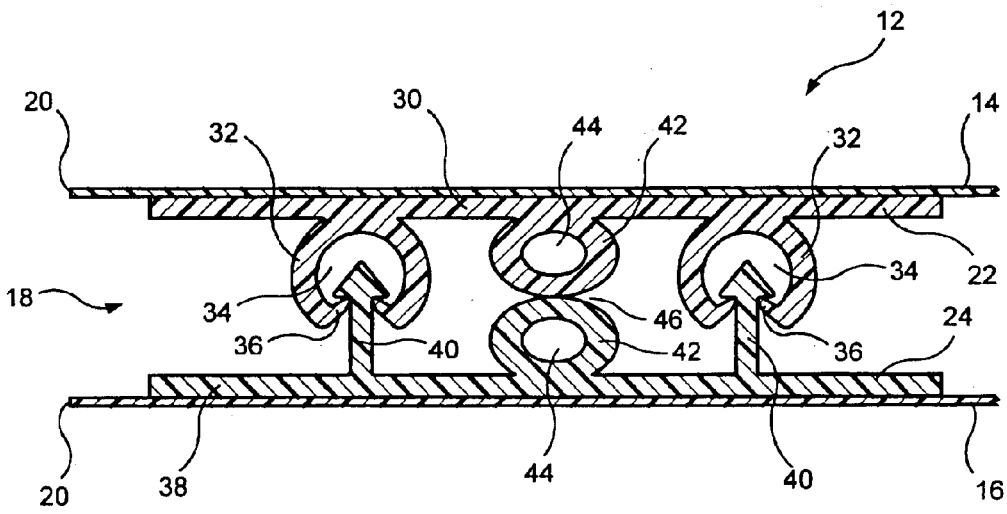
FIG. 2 is a cross-sectional view taken as indicated in FIG. 1 showing its watertight closure in a closed condition.

Referring now to the drawings, and specifically to FIGS. 1 and 2, a reclosable bag 10 having the watertight closure 12 of the present invention includes front and rear walls 14,16 seamed along three edges thereby forming an enclosure with an opening or mouth 18 along the top or fourth edge 20. Closures of this general type are commonly referred to as zippers.

The bag 10 is preferably made of thermoplastic material, such as polyethylene, by extrusion. Attached to the internal faces of walls 14,16 near mouth 18 are first and second mutually interlocking profiles 22,24, respectively, of watertight closure 12, which extends continuously across the width of the bag 10. The watertight closure 12, comprising the mutually interlocking profiles 22,24, serves to close the mouth 18 of the bag 10 when the profiles 22,24 are interlocked with one another. In general, the mutually interlocking profiles 22,24 are extruded from a polymeric resin material, such as polyethylene, and attached to the front and rear walls 16,18 at some stage in the process by which bags 10 are manufactured.

Although mutually interlocking profiles 22,24 are shown in FIG. 2 to be separate from and attached to front and rear walls 14,16, respectively, it should be understood that they may be integrally formed therewith by coextrusion. Specifically, profile 22 may be coextruded with rear wall 16, while profile 24 may be coextruded with front wall 14. Moreover, the front and rear walls 14,16 may be part of a single sheet which is folded along the bottom 26 and sealed along the sides 28 during the manufacture of the reclosable bag 10. Each of these variations may be used without departing from the scope of the present invention as defined in the appended claims.

Referring now, more specifically, to FIG. 2, a cross-sectional view taken as indicated in FIG. 1, the first and second mutually interlocking profiles 22,24 together comprise two sets of interlocking members. Specifically, as shown in FIG. 2, first profile 22 includes a web 30 having two female members 32 separated from one another thereon. Each female member 32 is essentially a U-shaped channel 34 having barbed edges 36.

Second profile 24 includes a web 38 having two male members 40 separated from one another thereon. Each male member 40 has an arrowhead-shaped cross section which is appropriately sized to enable it to be snapped into a female member 32 on the first profile 22. Moreover, the two male members 40 are separated from one another on web 38 of second profile 24 by an amount which enables them both to mate with their respective female members 32 on web 30 of first profile 22.

In the intervals between the two female members 32 on the first profile 22 and the two male members 40 on the second profile 24 are collapsible members 42 of substantially cylindrical cross section, although other shapes may be used. The collapsible members 42 have hollow cores 44, which allow the collapsible members 42 to collapse somewhat when under compression, as shown in FIG. 2, and to return essentially to their original shapes when compression is removed.

Collapsible members 42 may be coextruded with their respective first and second mutually interlocking profiles 22,24, or separately extruded from a polymeric resin material, such as polyethylene, and subsequently attached thereto. Collapsible members 42 are sized such that, when the male members 40 of second profile 24 are snapped into female members 32 of first profile 22, they encounter and compress one another to form a watertight seal 46 therebetween.

It should be understood that the present invention is not limited to the first and second mutually interlocking profiles 22,24 shown in FIG. 2. As such, the mutually interlocking profiles 22,24 need not have the specific male members 40 and female members 32 shown in FIG. 2, nor do both male members 40 need to be on one profile and both female members 32 on the other. All that is required is that there be two sets of mutually interlocking members separated from one another by an interval having at least one partially collapsible member which forms a watertight seal when the two sets of mutually interlocking members are joined to one another. When so joined, the two sets of mutually interlocking members, one on either side of the partially collapsible member or members, ensure that the partially collapsible member or members are compressed to form the watertight seal.

Figure 3:
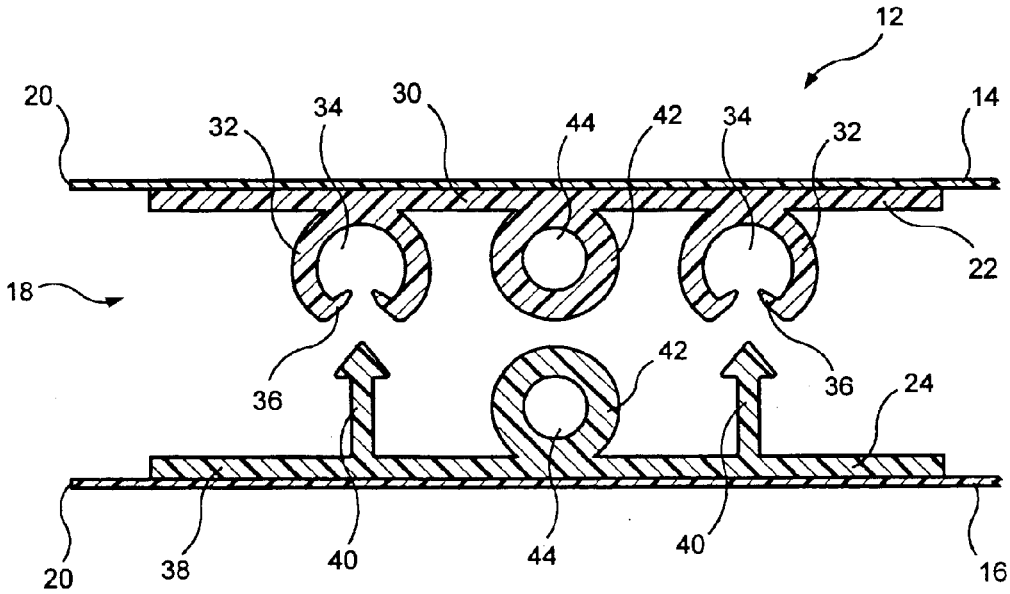
FIG. 3 is a cross-sectional view of the watertight closure of FIG. 2 in an open condition.

For the sake of completeness, FIG. 3 is a cross-sectional view of watertight closure 12 in an open condition where it is more apparent that the collapsible members 42 have a substantially cylindrical cross section when not under compression.

Figure 4:
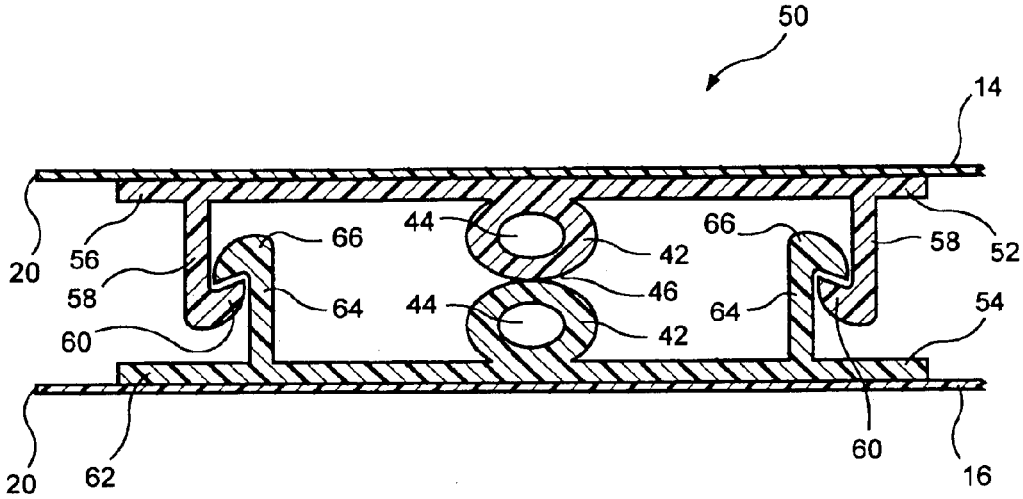
FIG. 4 is a cross-sectional view of an alternate embodiment of the watertight closure of the present invention.

FIG. 4 is a cross-sectional view of an alternate embodiment of the watertight closure of the present invention. Watertight closure 50 comprises first and second mutually interlocking profiles 52,54 which together comprise two sets of interlocking members. Specifically, first profile 52 includes a web 56 having two upstanding hook-like members 58 with barbed ends 60 facing toward one another. Hook-like members 58 are separated from one another on web 56.

Second profile 54 includes a web 62 having two upstanding hook-like members 64 with barbed ends 66 facing away from one another on web 62. Hook-like members 64 are separated from one another on web 62 sufficiently less than are hook-like members 58 on web 56 so that the barbed ends 60,66 of hook-like members 58,64, respectively, snappingly engage one another, as shown in FIG. 4, to join the first and second mutually interlocking profiles 52,54 to one another when closing a reclosable package.

As in the embodiment shown in FIGS. 2 and 3, in the intervals between the hook-like members 58 on the first profile 52 and the hook-like members 64 on the second profile 54 are collapsible members 42 of substantially cylindrical cross section. The collapsible members 42 have hollow cores 44, which allow the collapsible members 42 to collapse somewhat when under compression, as shown in FIG. 4, and to return essentially to their original shapes when compression is removed. As above, collapsible members 42 are sized such that, when the barbed ends 60,66 of hook-like members 58,64, respectively, are engaged with one another, they encounter and compress one another, to form a watertight seal 46 therebetween.

Figure 5A:
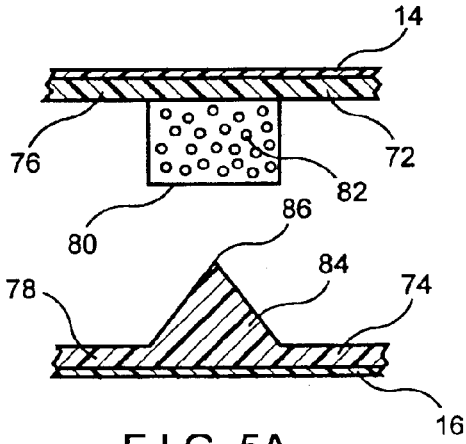
FIGS. 5A and 5B are cross-sectional views of the central portion of another embodiment of the watertight closure in an open and closed condition, respectively.
Figure 5B:
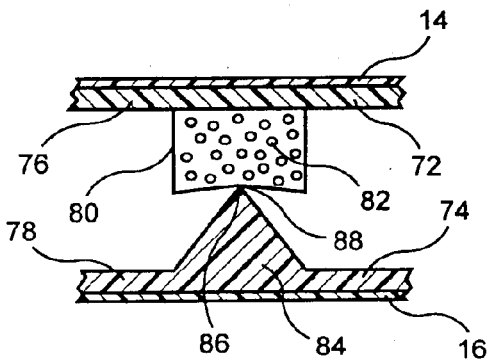

Just as the present invention is not limited to the specific designs for the first and second mutually interlocking profiles shown in FIGS. 2 through 4, so also it is not limited to the specific means, that is, the mutually facing collapsible members 42, shown for forming the watertight seal 46. Referring first to FIGS. 5A and 5B, they will be seen, for the sake of simplicity, to show cross sections of the central portion of first and second mutually interlocking profiles 72,74 between whatever mutually interlocking elements they may have.

FIG. 5A shows the central portion of the mutually interlocking profiles 72,74 in an open condition, while FIG. 5B shows the closed condition. As above, the first and second profiles 72,74 include webs 76,78, respectively. Extruded onto, or coextruded with, web 76 is a collapsible member 80 having a generally rectangular cross section, although other shapes may be used. The collapsible member 80 is of a foamed polymeric resin material, such as polyethylene, and is partially collapsible by virtue of the air bubbles 82 contained therein in the same manner as collapsible member 42 with its hollow core 44. Opposite the collapsible member 80 on web 78 is a compressing member 84 of triangular cross section, which may be extruded onto or coextruded with web 74, and which has an apex 86, although the compressing member 84 may be of other cross sectional shapes.

FIG. 5B shows the relationship between the collapsible member 80 and the compressing member 84 when the mutually interlocking profiles 72,74 are in a closed condition. The collapsible member 80 and the compressing member 84 are sized so that, when the first and second profiles 72,74 are in a closed condition, the apex 86 of compressing member 84 encounters and compresses collapsible member 80 to form a watertight seal 88 therebetween.

Figure 6A:
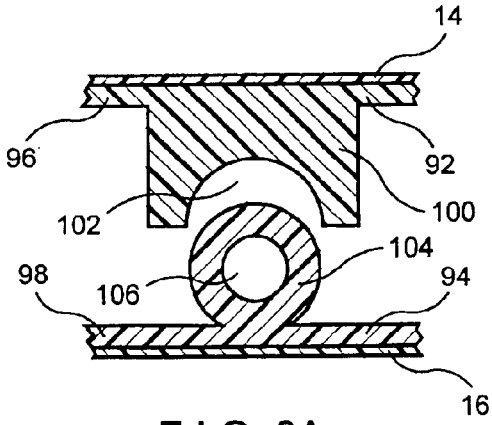
FIGS. 6A and 6B; 7A and 7B; 8A and 8B; 9A and 9B; 10A and 10B; and 11A and 11B are cross-sectional views analogous to those of FIGS. 5A and 5B for other embodiments of the watertight closure.
Figure 6B:
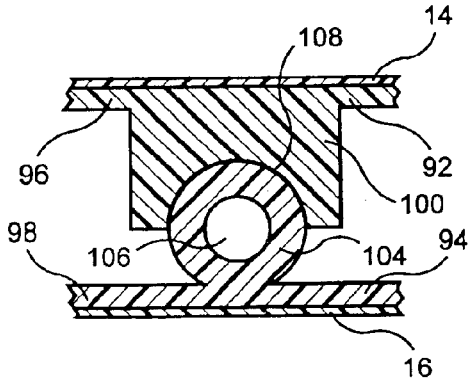

Referring to FIGS. 6A and 6B, they will be seen, again for the sake of simplicity, to show cross sections of the central portions of first and second mutually interlocking profiles 92,94 between whatever mutually interlocking elements they may have. As above, FIG. 6A shows the central portion of the mutually interlocking profiles 92,94 in an open condition, while FIG. 6B shows it in a closed condition.

The first and second profiles 92,94 include webs 96,98, respectively. Extruded onto, or coextruded with, web 96 is a member 100 of generally rectangular cross section having a groove 102 of semicylindrical cross section. Opposite to the groove 102 on web 98 is a collapsible member 104 of substantially cylindrical cross section with a hollow core 106, which allows the collapsible member 104 to collapse somewhat under compression. Collapsible member 104 may be extruded onto, or coextruded with, web 98. Collapsible member 104 has a diameter which is equal to or slightly larger than that of groove 102.

FIG. 6B shows the relationship between the groove 102 and the collapsible member 104 when the mutually interlocking profiles 92,94 are in a closed condition. Collapsible member 104 fits snugly into groove 102, perhaps collapsing slightly, to form a watertight seal 108 therebetween.

Figure 7A:
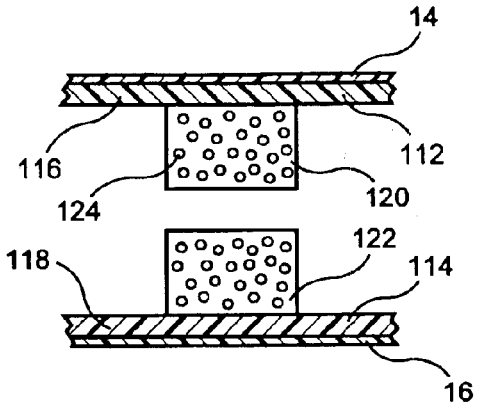
Figure 7B:
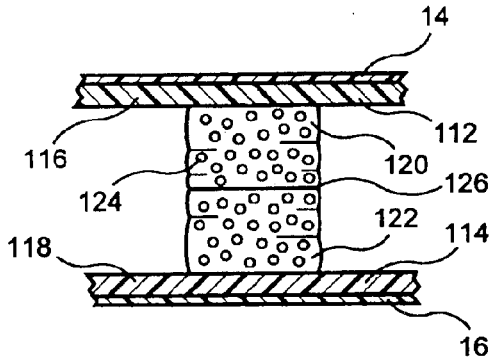

FIGS. 7A and 7B show cross sections of the central portions of first and second mutually interlocking profiles 112,114 between whatever mutually interlocking elements they may have. FIG. 7A shows the central portion of the mutually interlocking profiles 112,114 in an open condition, while FIG. 7B shows it in a closed condition.

The first and second profiles 112,114 include webs 116, 118, respectively. Extruded onto, or coextruded with, webs 116,118 are collapsible members 120,122, respectively, each having a generally rectangular cross section, although other shapes may be used. Collapsible members 120,122 are of a foamed polymeric resin material, such as polyethylene, and are partially collapsible by virtue of the air bubbles 124 contained therein. Collapsible members 120,122 face one another and are opposite to one another on webs 116,118, respectively.

FIG. 7B shows the relationship between the collapsible members 120,122 when the mutually interlocking profiles 112,114 are in a closed condition. The collapsible members 120,122 are sized so that, when the first and second profiles 112,114 are in a closed condition, they encounter and compress against one another to form a watertight seal 126.

Figure 8A:
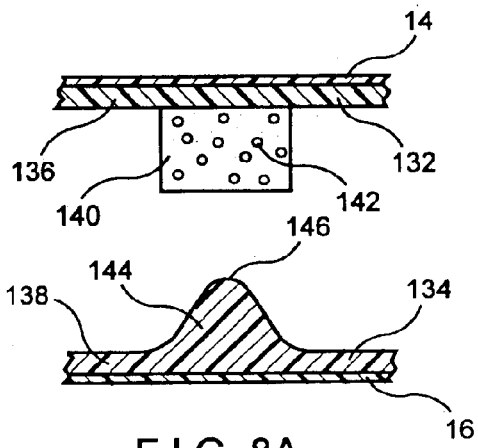
Figure 8B:
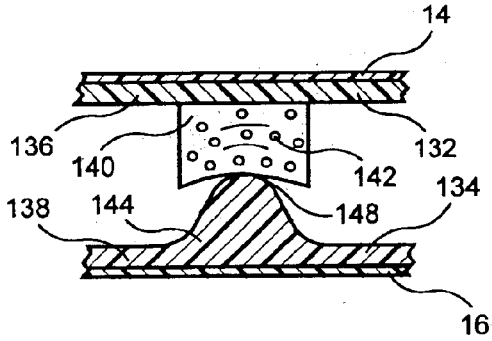

FIGS. 8A and 8B show an embodiment similar to that shown in FIGS. 5A and 5B. As such, FIGS. 8A and 8B show cross sections of the central portions of first and second mutually interlocking profiles 132,134 between whatever mutually interlocking elements they may have. FIG. 8A shows the central portion of the mutually interlocking profiles 132,134 in an open condition, while FIG. 8B shows it in a closed condition.

The first and second profiles 132,134 include webs 136, 138, respectively. Extruded onto, or coextruded with, web 136 is a collapsible member 140 having a generally rectangular cross section, although other shapes may be used. As above, the collapsible member 140 is of a foamed polymeric resin material, such as polyethylene, and is partially collapsible by virtue of the air bubbles 142 contained therein. Opposite the collapsible member 140 on web 138 is a compressing member 144, which may be extruded onto or coextruded with web 138, and which is rounded and has a top 146, although, as stated previously, the compressing member 144 may be of other cross sectional shapes.

FIG. 8B shows the relationship between the collapsible member 140 and the compressing member 144 when the mutually interlocking profiles 132,134 are in a closed condition. The collapsible member 140 and the compressing member 144 are sized so that, when the first and second profiles 132,134 are in a closed condition, the top 146 of the compressing member 144 encounters and compress collapsible member 140 to form a watertight seal 148 therebetween.

Figure 9A:
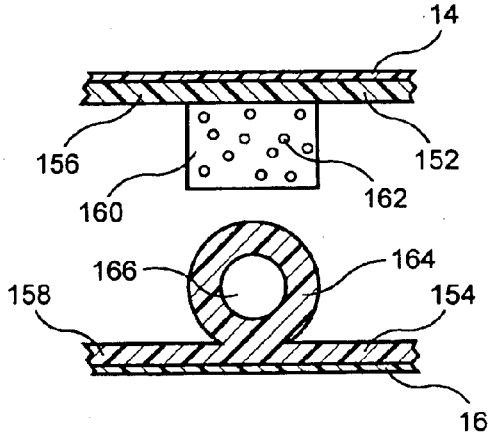
Figure 9B:
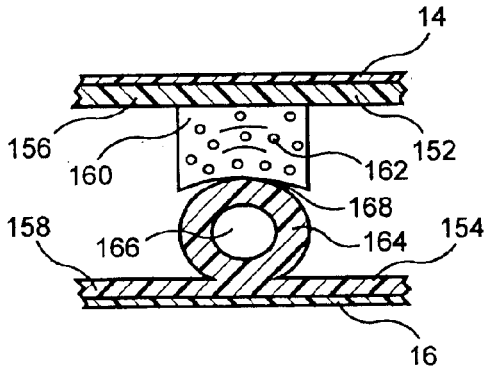

FIGS. 9A and 9B show cross sections of the central portions of first and second mutually interlocking profiles 152,154 between whatever mutually interlocking elements they may have. FIG. 9A shows the central portion of the mutually interlocking profiles 152,154 in an open condition, while FIG. 9B shows it in a closed condition.

The first and second profiles 152,154 include webs 156, 158, respectively. Extruded onto, or coextruded with, web 156 is a collapsible member 160 having a generally rectangular cross section, although other shapes may be used. As above, the collapsible member 160 is of a foamed polymeric resin material, such as polyethylene, and is partially collapsible by virtue of the air bubbles 162 contained therein. Opposite the collapsible member 160 on web 158 is a compressing member 164, which may be extruded onto or coextruded with web 158.

Compressing member 164 is itself also collapsible, and has a substantially cylindrical cross section, although other shapes may be used. Compressing member 164 has a hollow core 166, which allows it to collapse somewhat when under compression, as shown in FIG. 9B, and to return essentially to its original shape when compression is removed.

FIG. 9B shows the relationship between the collapsible member 160 and the compressing member 164 when the mutually interlocking profiles 152,154 are in a closed condition. The collapsible member 160 and the compressing member 164, itself also collapsible, are sized so that, when the first and second profiles 152,154 are in a closed condition, the compressing member 164 encounters and compresses collapsible member 160 to form a watertight seal 168 therebetween.

Figure 10A:
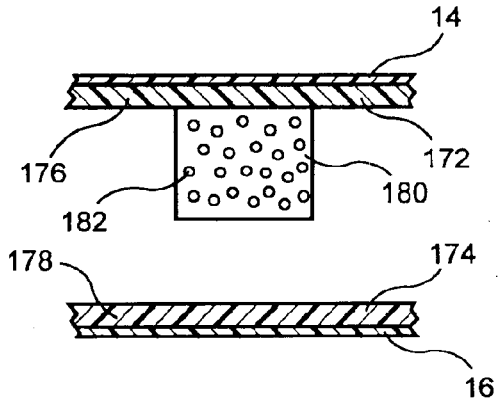
Figure 10B:
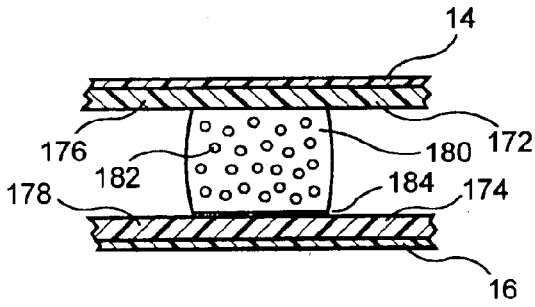

FIGS. 10A and 10B, and 11A and 11B, show alternate embodiments lacking a compressing member per se. Referring first to that shown in FIGS. 10A and 10B, these show cross sections of the central portions of first and second mutually interlocking profiles 172,174 between whatever mutually interlocking elements they have. FIG. 10A shows the open condition, while FIG. 10B shows the closed condition.

The first and second profiles 172,174 include webs 176, 178, respectively. Extruded onto, or coextruded with, web 176 is a collapsible member 180 having a generally rectangular cross section, although other shapes may be used. As above, the collapsible member 180 is of a foamed polymeric resin material, such as polyethylene, and is partially collapsible by virtue of the air bubbles 182 contained therein. There is no compressing member opposite collapsible member 180 on web 178 in this embodiment.

FIG. 10B shows the relationship between the mutually interlocking profiles 172,174 when they are in a closed condition. The collapsible member 180 is sized so that, when the first and second profiles 172,174 are in a closed condition, the collapsible member 180 encounters and compresses against web 178 to form a watertight seal 184 therebetween.

Figure 11A:
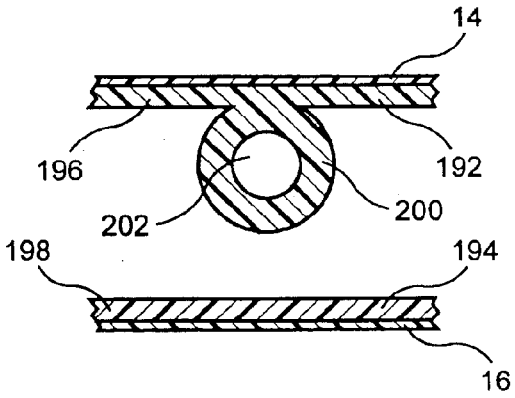
Figure 11B:
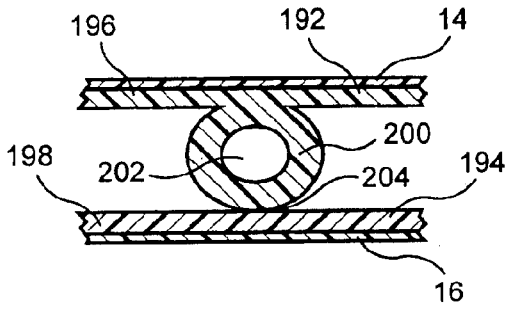

FIGS. 11A and 11B show cross sections of the central portions of first and second mutually interlocking profiles 192,194 between whatever mutually interlocking elements they may have. FIG. 11A shows the open condition, while FIG. 11B shows the closed condition.

The first and second profiles 192,194 include webs 196, 198, respectively. Extruded onto, or coextruded with, web 196 is a collapsible member 200, which has a substantially cylindrical cross section, although other shapes may be used. Collapsible member 200 has a hollow core 202, which allows it to collapse somewhat when under compression, as shown in FIG. 11B, and to return essentially to its original shape when compression is removed.

FIG. 11B shows the relationship between the mutually interlocking profiles 192,194 when they are in a closed condition. The collapsible member 200 is sized so that, when the first and second profiles 192,194 are in a closed condition, the collapsible member 200 encounters and compresses against web 198 to form a watertight seal 204 therebetween.

Figure 12:
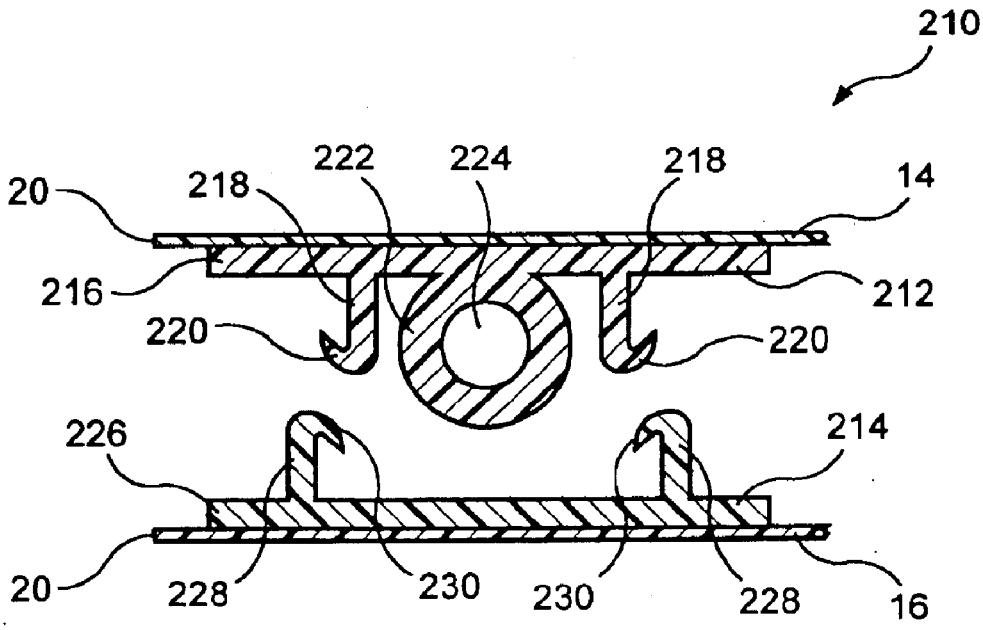
FIG. 12 is a cross-sectional view of another embodiment of the watertight closure in an open condition.
Figure 13:
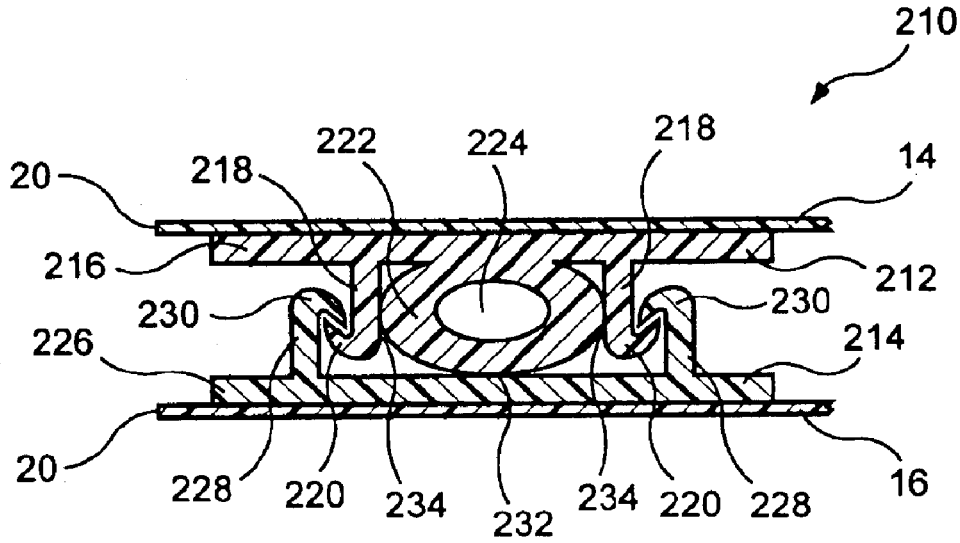
FIG. 13 is a cross-sectional view of the embodiment shown in FIG. 12 in a closed condition.

FIGS. 12 and 13 are cross-sectional views of yet another embodiment of the watertight closure of the present invention. FIG. 12 shows watertight closure 210 in an open condition, and FIG. 13 shows it in a closed condition. It will be noted that watertight closure 210 has a central portion like that shown in FIGS. 11A and 11B.

More specifically, watertight closure 210 comprises first and second mutually interlocking profiles 212,214 which together comprise two sets of interlocking members. First profile 212 includes a web 216 having two upstanding hook-like members 218 with barbed ends 220 facing away from one another. Hook-like members 218 are separated from one another on web 216. Between hook-like members 218 on web 216 is a collapsible member 222, which has a substantially cylindrical cross section, although other shapes may be used. Collapsible member 222 has a hollow core 224, which allows it to collapse somewhat when under compression.

Second profile 214 includes a web 226 having two upstanding hook-like members 228 with barbed ends 230 facing toward one another on web 226. Hook-like members 228 are separated from one another on web 226 sufficiently more than are hook-like members 218 on web 216 so that the barbed ends 220,230 of hook-like members 218,228, respectively, snappingly engage one another, as shown in FIG. 13, to join the first and second mutually interlocking profiles 212,214 to one another when closing a reclosable package.

As discussed above in connection with FIGS. 11A and 11B, collapsible member 222 is sized such that, when the barbed ends 220,230 of hook-like members 218,228, respectively, are engaged with one another, collapsible member 222 encounters and compresses against web 226 to form a watertight seal 232 therebetween. In addition, in this embodiment, hook-like members 218 are separated from one another on web 216 such that collapsible member 222 also encounters and compresses against hook-like members 218 to form two additional watertight seals 234.

Figure 14:
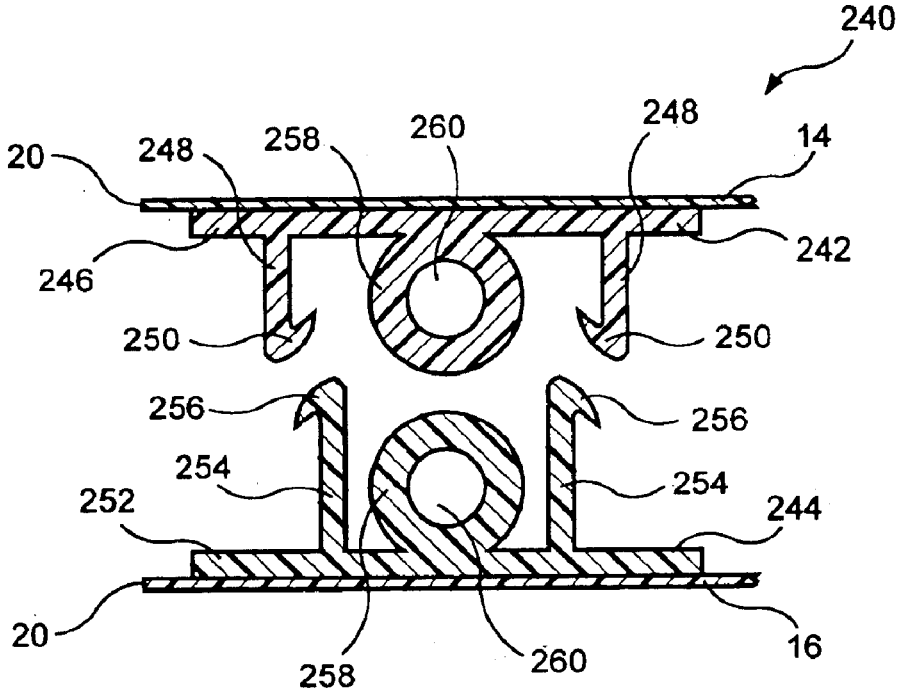
FIG. 14 is a cross-sectional view of yet another embodiment of the watertight closure in an open condition.
Figure 15:
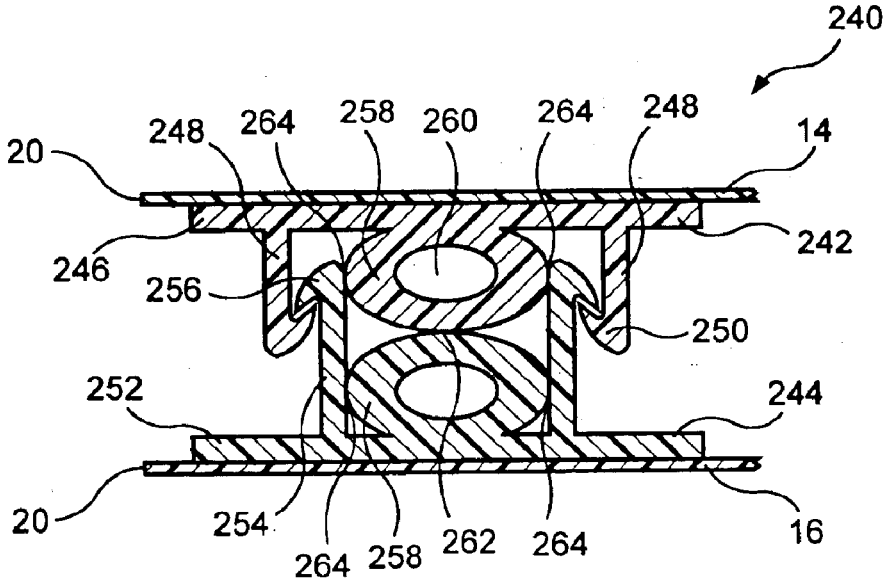
FIG. 15 is a cross-sectional view of the embodiment shown in FIG. 14 in a closed condition.

FIGS. 14 and 15 are cross-sectional views of still another embodiment of the watertight closure of the present invention. Upon inspection, it will be noted that the watertight closure 240, shown in an open condition in FIG. 14 and in a closed condition in FIG. 15, is the same as that shown in FIG. 4, except that the upstanding hook-like members are closer to one another so that additional watertight seals may be formed in the manner of the embodiment shown in FIGS. 12 and 13.

More specifically, watertight closure 240 comprises first and second mutually interlocking profiles 242,244 which together comprise two sets of interlocking members. That is, first profile 242 includes a web 246 having two upstanding hook-like members 248 with barbed ends 250 facing toward one another. Hook-like members 248 are separated from one another on web 246, although by less than are those in FIG. 4.

Second profile 244 includes a web 252 having two upstanding hook-like members 254 with barbed ends 256 facing away form one another on web 252. Hook-like members 254 are separated from one another on web 252 sufficiently less than are hook-like members 248 on web 246 so that the barbed ends 250,256 of hook-like members 248,254, respectively, snappingly engage one another, as shown in FIG. 15, to join the first and second mutually interlocking profiles 242,244 to one another when closing a reclosable package.

As in the embodiment shown in FIG. 4, in the intervals between the hook-like members 248 on the first profile 242 and the hook-like members 254 on the second profile 244 are collapsible members 258 of substantially cylindrical cross section. The collapsible members 258 have hollow cores 260, which allow the collapsible members 258 to collapse somewhat when under compression, as shown in FIG. 15, and to return essentially to their original shapes when compression is removed. Collapsible members 258 are sized such that, when the barbed ends 250,256 of hook-like members 248,254, respectively, are engaged with one another, they encounter and compress one another to form a watertight seal 262 therebetween. In addition, in this embodiment, hook-like members 254 are separated from one another on web 252 and are of a sufficient length such that collapsible members 258 also encounter and compress against hook-like members 254 to form four additional watertight seals 264.

Clearly, the specific aspects of the first and second mutually interlocking profiles and of the manner in which the watertight seal may be formed between them may be subjected to numerous modifications without bringing the invention so modified beyond the scope of the appended claims.

What is claimed is:

1. A watertight closure for a reclosable package comprising:

a first and a second mutually interlocking profile, said first and second mutually interlocking profiles together having two sets of interlocking members separated from one another by a central portion thereof, each of said first and second mutually interlocking profiles having a web and two interlocking members separated from one another thereon, said web of said first mutually interlocking profile being in a substantially parallel orientation to said web of said second mutually interlocking profile, wherein each of said interlocking members of said first and second mutually interlocking profiles is located on a side of said web facing toward the web of the other mutually interlocking profile;

a first collapsible member on the web of said first mutually interlocking profile between its respective interlocking members; and a second collapsible member on the web of said second mutually interlocking profile between its respective interlocking members, said second collapsible member being opposite said first collapsible member, said first and second collapsible members encountering and compressing one another when said first and second mutually interlocking profiles are joined to one another to create a watertight seal in said central portion thereof.

2. A watertight closure as claimed in claim 1 wherein said first collapsible member has a substantially cylindrical cross section and a hollow core.

3. A watertight closure as claimed in claim 1 wherein said second collapsible member has a substantially cylindrical cross section and a hollow core.

4. A reclosable package comprising;

a first wall and a second wall joined to form an enclosure with a mouth defined by wall edges, and a watertight closure for selectively opening and closing said reclosable bag, said watertight closure comprising a first and a second mutually interlocking profile, said first profile extending along an internal surface of said first wall adjacent to said mouth and said second profile extending along an internal surface of said second wall adjacent to said mouth, wherein said first and second mutually interlocking profiles together have two sets of interlocking members separated from one another by a central portion thereof, each of said first and second mutually interlocking profiles having a web and two interlocking members separated from one another thereon, said web of said first mutually interlocking profile being in a substantially parallel orientation to said web of said second mutually interlocking profile, wherein each of said interlocking members of said first and second mutually interlocking profiles is located on a side of said web facing toward the web of the other mutually interlocking profile;

wherein a first collapsible member is on the web of said first mutually interlocking profile between its respective interlocking members; and wherein a second collapsible member is on the web of said second mutually interlocking profile between its respective interlocking members, said second collapsible member being opposite said first collapsible member, said first and second collapsible members encountering and compressing one another when said first and second mutually interlocking profiles are joined to one another to create a watertight seal in said central portion thereof.

5. A reclosable package as claimed in claim 4 wherein said first collapsible member has a substantially cylindrical cross section and a hollow core.

6. A reclosable package as claimed in claim 4 wherein said second collapsible member has a substantially cylindrical cross section and a hollow core.

* * * * *